United States Patent [19]

Brännström

[11] Patent Number: 4,860,536

[45] Date of Patent: Aug. 29, 1989

[54] POWER PLANT WITH DRYING MEANS FOR FUEL

[75] Inventor: Roine Brännström, Finspong, Sweden

[73] Assignee: ABB Stal AB, Sweden

[21] Appl. No.: 172,094

[22] Filed: Mar. 23, 1988

[30] Foreign Application Priority Data

Mar. 25, 1987 [SE] Sweden ..... 8701231

[51] Int. Cl.[4] ..... F02C 3/26

[52] U.S. Cl. ..... 60/39.464; 34/57 A; 110/266

[58] Field of Search ..... 60/39.12, 39.464; 34/57 A; 110/263, 266; 122/4.0; 431/170

[56] References Cited

U.S. PATENT DOCUMENTS

| | | | |
|---|---|---|---|
| 2,677,234 | 5/1954 | Secord | 60/39.464 |
| 3,912,002 | 10/1975 | Elliott . | |
| 4,159,682 | 7/1979 | Fitch et al. . | |
| 4,292,742 | 10/1981 | Ekberg . | |
| 4,304,049 | 12/1981 | Curtius . | |
| 4,414,905 | 11/1983 | Beranek et al. . | |
| 4,449,483 | 5/1984 | Strohmeyer | 110/263 |
| 4,499,944 | 2/1985 | Komakine . | |
| 4,552,203 | 11/1985 | Chrysostowe et al. | 122/4 D |
| 4,590,868 | 5/1986 | Ishihara | 60/39.464 |
| 4,627,173 | 12/1986 | O'Hagan et al. | 34/57 A |

*Primary Examiner*—Louis J. Casaregola

*Attorney, Agent, or Firm*—Pollock Vande Sande & Priddy

[57] ABSTRACT

A power plant burning a fuel, primarily coal, in a bed vessel with a fluidized bed of a particulate material at a pressure exceeding atmospheric pressure. Consumed bed material and/or ashes separated from combustion gases are removed through a pressure-reducing discharge means. A part of the pressure-reducing discharge means is located in a dryer for crushed coal which forms a bed arranged as a bed vessel where crushed coal to be dried forms a fluidizable bed. The bed is fluidized by gas introduced through nozzles in the bottom of the bed vessel. The discharge portion constitutes a heater for the bed and a cooler for the discharge portion.

5 Claims, 1 Drawing Sheet

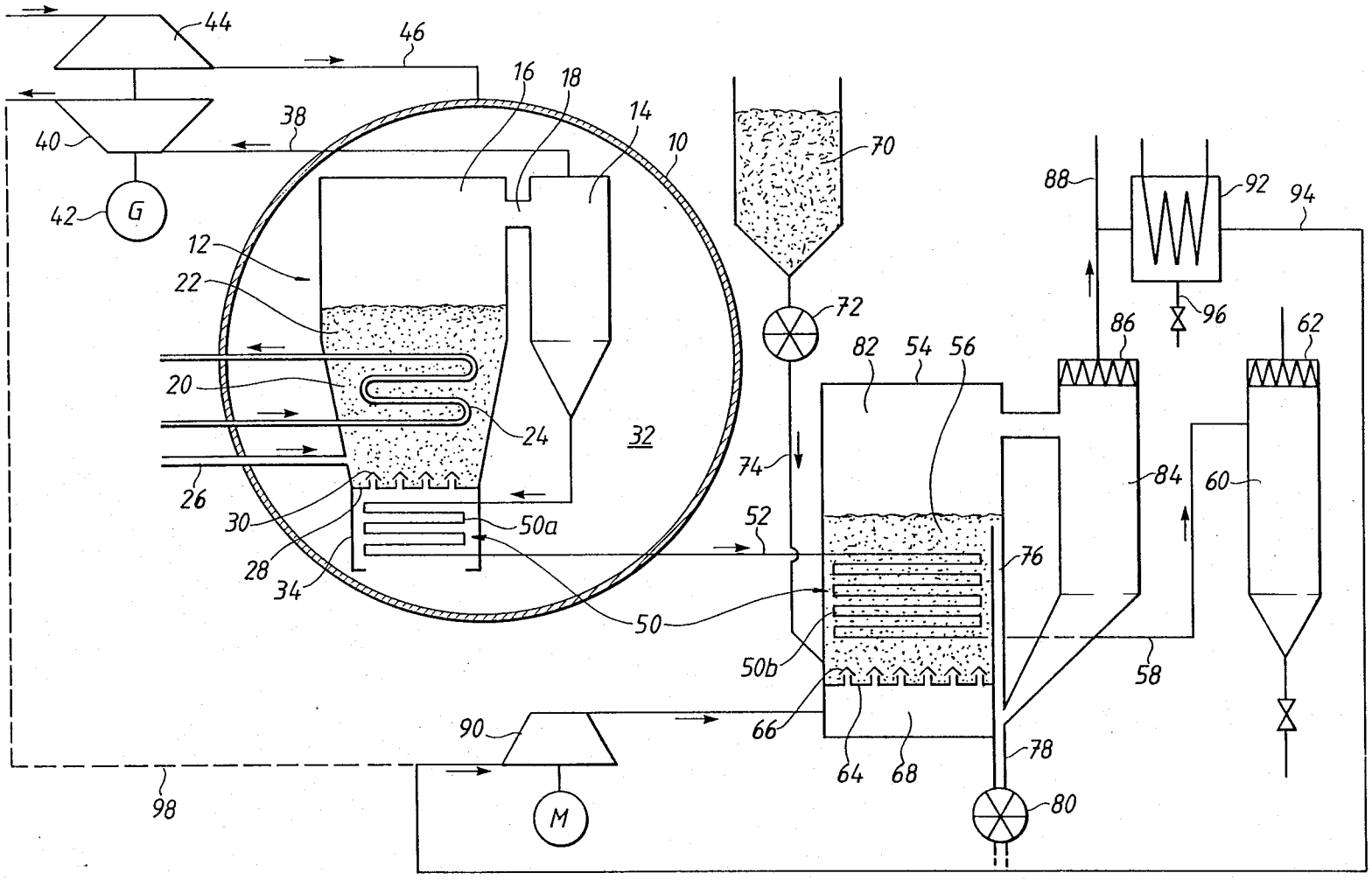
10
12
14
16
18
20
22
24
26
28
30
32
34
38
40
42
44
46
50
50a
50b
52
54
56
58
60
62
64
66
68
70
72
74
76
78
80
82
84
86
88
90
92
94
96
98
G
M

POWER PLANT WITH DRYING MEANS FOR FUEL

TECHNICAL FIELD

The invention relates to a power plant burning a fuel in a fluidized bed of particulate material at a pressure exceeding atmospheric pressure, a PFBC power plant. PFBC are the initial letters of the term Pressurized Fluidized Bed Combustion. It relates particularly to a power plant having a bed vessel located inside a pressure vessel and surrounded by compressed combustion air.

BACKGROUND ART

Fuel, such as crushed coal, often has such a high moisture content that it is not suitable for pneumatic transportation. The high moisture content entails considerable risk of clogging in pneumatic transport pipes. For this reason it is advisable to dry the fuel before transporting it pneumatically to a combustion chamber. Particulate material is preferably dried in a bed vessel where it forms a bed which is maintained in fluidized state by a gas blown in through nozzles in a bottom supporting the bed. Heat is supplied to the bed either through the fluidizing gas or be heaters in the bed. U.S. Pat. No. 4,304,049 describes a method and equipment for drying moist material in a fluidized bed.

SUMMARY OF THE INVENTION

According to the invention a PFBC power plant includes a second bed vessel to dry a particulate fuel, usually crushed coal, in a fluidized bed. The bed consists wholly or partially of fuel, which is fluidized by gas supplied to the bed through openings or nozzles in a bottom supporting the bed. At least a part of a pneumatic pressure-reducing discharge means for ashes or bed material is located in the bed vessel and provides a source of heat for the bed and a cooler for ash and the transport gas therefor. This pressure-reducing discharge means may comprise a number of series-connected, parallel pipe sections joined to turning chambers which deflect the material/gas flow 180° between the downstream end of one pipe and the upstream end of the next pipe. Such a pressure-reducing discharge means is described in European Pat. No. 0 108 505. The gas for fluidization of the bed and removal of vaporized moisture may be air but should preferably consist of an inert gas or a gas poor in oxygen in view of the risk of the fuel igniting. Combustion gases leaving the gas turbine associated with the plant may be used. Another possibility is to circulate gas within the drying installation. A compressor for circulating the gas may be connected to the outlet from the drier and is suitably connected through a cooler which removes moisture from the gas before it is compressed.

In a PFBC power plant with a bed vessel inside a pressure vessel and discharge means for ash or bed material in a channel or shaft conducting compressed combustion air to the bed vessel, cooling is limited by the temperature of this air. The air temperature is so high, up to 300° C., that cooling to a temperature below 350° C. is scarcely possible. By placing a portion of the discharge means in a bed vessel for drying fuel, additional heat can be exploited as the ash or bed material is further cooled by the surrounding temperature.

BRIEF DESCRIPTION OF THE DRAWING

The accompanying DRAWING shows schematically a PFBC power plant in which the invention is utilized.

DETAILED DESCRIPTION OF THE PREFERRED EMBODIMENT

In the DRAWING, 10 designates a pressure vessel. A bed vessel 12 and gas-cleaning plant 14 to separate dust from the fuel gases leaving the free-board 16 of the bed vessel through the outlet pipe 18. The gas-cleaning plant 14 generally comprises a number of parallel-connected groups of series-connected cyclones. The lower part of the bed vessel 12 forms a combustion chamber 20. In this is a fluidizable bed 22 of a particulate material consisting at least partially of a sulphur-absorbent such as limestone or dolomite. Tubes 24 are located in the combustion chamber 20 which, dependent on the output extracted from the plant, are either wholly or partially surrounded by bed material 20. The tubes are utilized both to generate steam to drive a steam turbine, not shown, and also to cool the bed so that its temperature is kept within permissible limits, i.e. about 800°–950° C. Fuel is supplied to the combustion chamber 20 through a pipe 26 with its orifice in the lower part of the combustion chamber 20 just above the bottom 28 of the bed vessel. This bottom is provided with nozzles 30 through which compressed air is supplied from the space 32 through shaft 34 and nozzles 30 to the combustion chamber 20 to effect fluidization of the bed 22 and combustion of the fuel supplied.

The combustion gases from the cleaning plant 14 are conducted through pipe 38 to the turbine 40. This drives a generator 42 and a compressor 44. In the compressor 44 compressed air is transported through conduit 46 to the space 32. The compressed combustion air may have a pressure of up to 20 bar.

Dust separated in the cleaning plant 14 is continuously removed through a pressure-reducing discharge means 50 which also cools the dust and transport gas transported through the discharge means. It is divided into two parts **50*a* and 50*b*. Both these parts consist of a number of parallel pipes connected in series with chambers joining the downstream end of one pipe to the upstream end of the next pipe. The part 50*a* is located in shaft 34 and is cooled by the combustion air on its way to nozzles 30 in the bottom 28**. During this cooling process the combustion air is pre-heated and the energy is thus exploited.

The temperature of the combustion air is increased by compression in the compressor 44 and it is further increased in the space 32 due to heat losses from the bed vessel 12 and units in the cleaning plant 14. As mentioned earlier, the temperature of the air entering the shaft 34 may be 300° C. or more, which limits cooling of the dust and transport gas to about 350° C. The dust/gas flow is conveyed through conduit 52 to part **50*b* of the dust discharge means, this part being located in a separate bed vessel 54 outside the pressure vessel 10. Here the dust/gas flow is further cooled and the heat used to dry crushed coal forming the bed 56. The dust/gas flow is conducted from the discharge part 50*b* through conduit 58 to container 60 where the dust is separated from the transport gas. Container 60 is under atmospheric pressure. The transport gas is directed through a filter 62 to the atmosphere. The lower part of the bed vessel 54 has a bottom 64 with nozzles 66 and an air-distributing chamber 68 for gas to fluidize the bed 56 and to remove vaporized moisture. Crushed coal from a container 70 is supplied to the bed vessel 54 through a cell-feeder 72 and a conduit 74. An outlet 76 for dried coal is arranged in the bed vessel 54, at the side immediately opposite the supply conduit 74. A cell-feeder 80 to control the material flow is provided in an outlet pipe 78 from the outlet 76. The gas is conducted from the free-board 82 in the bed vessel 54 of the drying plant, to the dust-separator 84, the lower end of which is connected to the outlet 76. The fluidization gas and water vapor generated are withdrawn through a filter 86 and a conduit 88. The supply of moist coal should be regulated so the moisture content does not fall below the dew point of gases in the free-board 82** and the dust separator.

In view of the risk of fire and explosion, the gas used to effect fluidization of the bed 56 of coal should be poor in oxygen or inert. One method is to circulate gas in the drying plant as shown in the drawing. A compressor 90 for fluidization gas may be connected to the conduit 88 through a cooler 92 and a conduit 94. Water vapor is condensed in the cooler 92 and the condensate removed through a conduit 96. Due to the temperature increase during compression in the compressor 90, the relative moisture falls so that the fluidization gas is relatively dry when it is supplied to the bed vessel 54. Gas leaving the gas turbine 40 may also be used as fluidization gas in the bed vessel 54. The compressor is then connected to an outlet pipe from the turbine 40 by the conduit 98 indicated in broken lines.

I claim:

1. A power plant burning a fuel, primarily coal, in a fluidized bed of particulate material at a pressure exceeding atmospheric pressure, comprising:

a first bed vessel having a bottom provided with at least one nozzle for supplying the bed vessel with air to effect fluidization of the bed material and combustion of the fuel supplied to the bed vessel;

a turbine driven by combustion gases generated in the bed vessel;

a compressor for compressing the air for the fluidization and combustion processes;

a gas cleaner for separating ashes from the combustion gases before supplying the combustion gases to the turbine;

a pressure-reducing pneumatic ash discharge means located in the bed vessel below the bottom, for receiving ashes from said gas cleaner, said pressure-reducing ash discharge means having a plurality of series-connected pipe sections and turning sections for conveying ashes in a gas/ash flow with deflection of the gas/ash flow direction between the pipe sections, said pressure-reducing ash discharge means being arranged as a cooler for the gas/ash flow;

a second bed vessel forming a dryer for moisture containing fuel;

at least a part of the discharge means being arranged within said second bed vessel;

means for supplying the moisture containing particulate fuel to be dried to the second bed vessel, said fuel forming bed material around said at least a part of the discharge means and acting as a cooling medium for said gas/ash flow, said discharge means acting as a heater for said bed material;

means for supplying gas to said second bed vessel for fluidizing said bed material and removing vaporized moisture; and means for discharging said particulate fuel from said second bed vessel after being dried.

2. A power plant as claimed in claim 1, wherein said gas for fluidization of the bed material in said second bed vessel is air.

3. A power plant as claimed in claim 1, wherein said gas for fluidization of the bed material in said second bed vessel is an inert gas.

4. A power plant as claimed in claim 1, wherein said gas for fluidization of the bed material in said second bed vessel is a gas poor in oxygen.

5. A power plant as claimed in claim 1, wherein said gas for fluidization of the bed material in said second bed vessel is combustion gas supplied from said turbine.

* * * * *